United States Patent [19]

Ashworth

[11] Patent Number: 5,031,501

[45] Date of Patent: Jul. 16, 1991

[54] METHOD FOR ATTACHING AN AUDIO TRANSDUCER TO A STRING MUSICAL INSTRUMENT

[76] Inventor: William J. Ashworth, 1012 Ashworth Cove, Altamonte Springs, Fla. 32714

[21] Appl. No.: 495,698

[22] Filed: Mar. 19, 1990

[51] Int. Cl.[5] ..... G10F 5/00; G10H 3/00; G10K 9/12

[52] U.S. Cl. ..... 84/723; 84/743

[58] Field of Search ..... 84/723–734, 84/743

[56] References Cited

U.S. PATENT DOCUMENTS 2,486,647 2/1946 Harker ..... 84/726

3,725,561 4/1973 Paul ..... 84/726

*Primary Examiner*—William M. Shoop, Jr.

*Assistant Examiner*—Brian Sircus

[57] ABSTRACT

A simple method of attaching an audio transducer to a sounding board of a string musical instrument without altering or disturbing the function of the component parts of the instrument, so the instrument can be electrically activated to produce sound without being played by a musician or together with a musician playing the instrument.

1 Claim, 1 Drawing Sheet

METHOD FOR ATTACHING AN AUDIO TRANSDUCER TO A STRING MUSICAL INSTRUMENT

BACKGROUND OF THE INVENTION

The present invention relates to audio transducers and string musical instruments such as violins, chellos, bass violas, guitars, etc. Heretofore it has been known that an audio transducer could be attached to the sounding board of a string musical instrument to activate the instrument electrically. This has been advantageous because when the sound board of a string musical instrument is mechanically activated over periods of time, the wood is flexed and artifically aged. This flexing can be done over long periods of time by electrically activating an audio transducer connected to the sounding board of the musical instrument with a sound signal from a signal source. The present invention can also be advantageous when teaching music students and can also be used so sound can be superimposed upon the sound produced by the musician playing the instrument. Previously, it has been necessary to alter the instrument by gluing a block of wood to the instrument to screw the audio transducer into or place a hole in the instrument to secure the audio transducer to the instrument. The present invention provides a novel and simple method for attaching an audio transducer to a string musical instrument without disturbing or altering any of the component parts of the musical instrument.

SUMMARY OF THE INVENTION

Audio transducers and string musical instruments are well known to the art so their operation will not be explained in this application. The present invention utilizes a simple method of attaching an audio transducer to a string musical instrument without disturbing the functions of any of the musical instrument's component parts. An audio transducer is connected to a vertical threaded screw member. The threaded screw member extends through a threaded lateral arm member. The lateral arm member is lowered downward until it will fit under the strings of the musical instrument. The base of the threaded screw rests against the sounding board of the musical instrument. The lateral arm is then elevated by turning the threaded screw member until the strings of the instrument exert enough spring tension against the lateral arm to hold it securely in place, thereby causing the base of the threaded screw member to exert pressure on the instrument sounding board, securing the present invention in place. This invention can be located at any desirable position on the instrument sounding board. It may be located in front or behind the instrument's bridge. If the instrument is to be played by a musician together with sound superimposed on the instrument by an external sound signal, the invention should be positioned behind the instrument's bridge so it will not interfere with the musician's movements. When the present invention is used for artifically aging an instrument, it should be located near the instrument's bridge.

DESCRIPTION OF THE PREFERRED EMBODIMENTS

Figure 1:
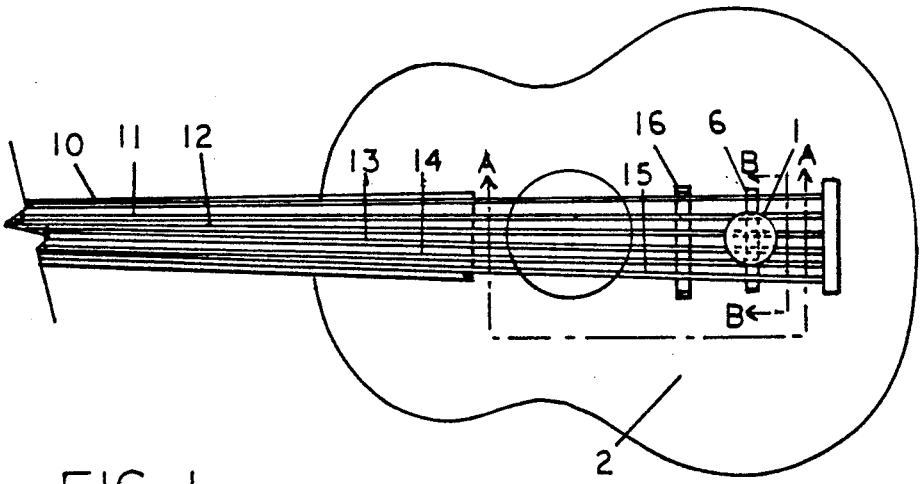
FIG. 1 is a front elevation view of the present invention.
Figure 2:
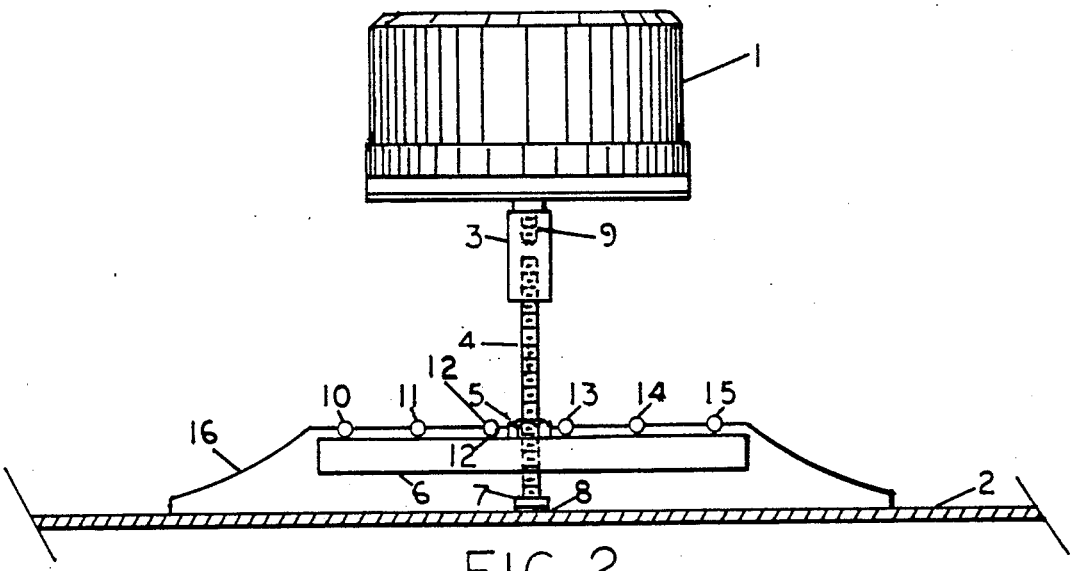
FIG. 2 is a side elevation view of the present invention.
Figure 3:
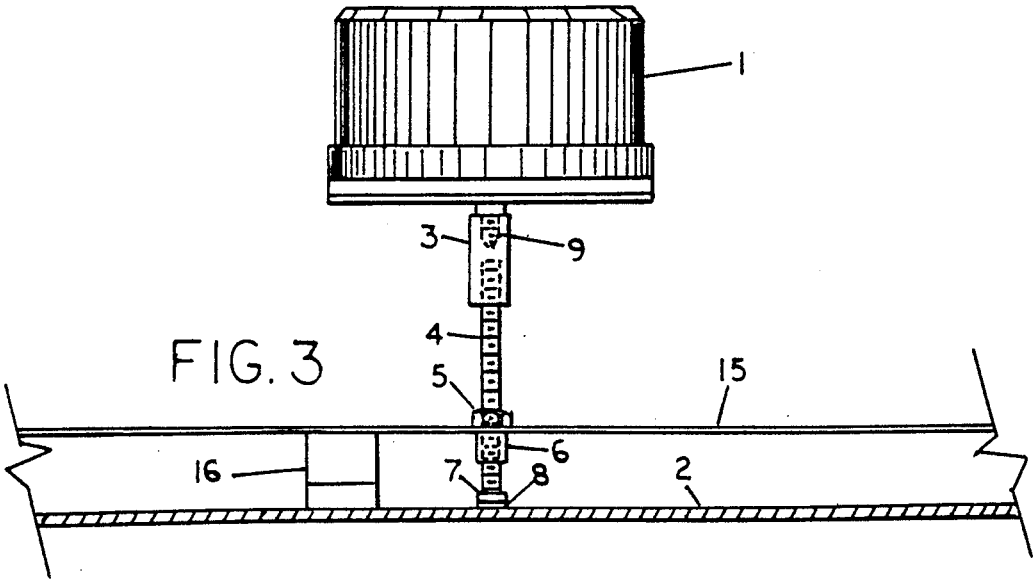

An electrically activated audio transducer 1 is attached to a string musical instrument sounding board 2 with connector members 3,4,5,6,7,8, and 9. Transducer 1 is attached to threaded screw 4 with member 3. Member 4 may be constructed from a $\frac{3}{8}''$ round wood member. Transducer 1 is connected to member 3 with screw 9 or any other suitable means. Threaded member 4 is also screwed or driven into member 3 or secured by any other suitable means. Screw 4 may be $1\frac{1}{4}$ inches long and have a 4–40 thread. Lateral arm 6 may be constructed from 3/16" square steel or aluminum with a 4–40 size threaded hole thru it. Nut 5 and lateral arm 6 is positioned on screw 4 before screw 4 is attached to member 3. Base 7 is the head of screw 4. Cushion 8 is cemented to base 7 with any suitable cement. Cushion 8 serves as a buffer between base 7 and sounding board 2. This buffer's purpose is to protect the musical instrument's finish and may be constructed from cardboard, felt, rubber, or any other suitable buffer material. To connect the present invention to a string instrument such as a guitar, lateral arm 6 and nut 5 are lowered down to base 7 by rotating transducer 1. With lateral arm 6 at its lower position, lateral arm 6 is placed below strings 10,11,12,13,14, and 15. Lateral arm 6 is then elevated by rotating transducer 1 until lateral arm 6 is urged against the instrument's strings, which produces downward pressure on base 7, urging base 7 and buffer 8 against sounding board 2. The amount of tension exerted by base 7 and buffer 8 against sounding board 2 can be adjusted by rotating transducer 1. When the desired tension is obtained, tighten locknut 5 against arm 6. When an electrical sound signal is applied to transducer 1, the resulting vibrations will be transferred to sounding board 2 thru members 3,4,7, and 8. The present invention can be mounted at a desirable location on the sounding board, either in front of or behind the bridge. The preferred embodiment is shown as being used in a guitar in the drawings but can be used on any string instrument. The bridge 16 of a guitar is shorter than a violin, chello, or bass viola. If the present invention is used on a violin, lateral arm 6 must move higher on screw 4 by rotating transducer 1 so as to press against the two outer strings of the violin. The same thing will be true for a chello or bass viola. The preferred embodiment shown in the drawings in suitable for a guitar and violin. For use with a chello or bass viola, a suitable extention must be used because the bridges for these instruments are much higher than a guitar or violin bridge. A suitable extention may be a longer screw 4. The present invention is easily removable from the instrument. Although one form of the present invention has been shown, it will be understood that details of the construction may be altered or omitted without departing from the spirit of this disclosure as defined by the following claim.

I claim:

1. A device for the transmission of vibrations generated by an audio transducer to the sounding board of a string musical instrument, where said transducer has a vibration transmission means extending from it to engage with said sounding board of said musical instrument whereby said vibration transmission means also has an attached lateral member that locates beneath the strings of said musical instrument with said lateral member being urged upward against said strings causing said device to be held firmly in place and urging said vibration transmission means against said sounding board, thereby causing efficient vibration transmission from said audio transducer to said musical instrument's sounding board.

* * * * *